US007492235B2

(12) United States Patent
Vice

(10) Patent No.: US 7,492,235 B2
(45) Date of Patent: Feb. 17, 2009

(54) TRANSMISSION LINE TRANSISTOR ATTENUATOR

(75) Inventor: Michael Vice, El Granada, CA (US)

(73) Assignee: Avago Technologies Wireless IP (Singapore) Pte. Ltd., Singapore (SG)

( * ) Notice: Subject to any disclaimer, the term of this patent is extended or adjusted under 35 U.S.C. 154(b) by 153 days.

(21) Appl. No.: 11/585,889

(22) Filed: Oct. 25, 2006

(65) Prior Publication Data

US 2008/0100404 A1 May 1, 2008

(51) Int. Cl.
*H01P 1/22* (2006.01)

(52) U.S. Cl. ..... 333/81 A

(58) Field of Classification Search ..... 333/81 A, 333/81 R; 327/308

See application file for complete search history.

(56) References Cited

U.S. PATENT DOCUMENTS

2005/0030121 A1 * 2/2005 Gilbert ..... 333/81 R

* cited by examiner

*Primary Examiner*—Stephen E Jones

(57) ABSTRACT

An attenuator has an input adapted to receive a signal to be attenuated, and an output adapted to output an attenuated signal, and a shunt transmission line transistor having a gate transmission line adapted to receive an attenuator control voltage, a source configured as a source transmission line, and a drain configured as a drain transmission line. One of the source transmission line and drain transmission line is connected to ground and the signal to be attenuated passes through the other of the source transmission line and drain transmission line.

20 Claims, 4 Drawing Sheets

TRANSMISSION LINE TRANSISTOR ATTENUATOR

BACKGROUND

As attenuator circuits that include transistor elements are called upon to operate into the microwave and millimeter wave frequency ranges over broader bandwidths, the lumped capacitance of the transistors becomes increasingly difficult to tolerate. At frequencies below a few gigahertz the capacitance can be neglected by selecting a process and transistor design that produces a sufficiently small capacitance. Alternatively, when only a narrow bandwidth is required, then the capacitance can be absorbed into a reactive matching network. However, in transistors operating across multi-octave bandwidths above a few gigahertz, then neither of the preceding solutions is very effective.

To address this problem, the distributed amplifier was developed. A distributed transistor structure is realized by dividing the transistor periphery into an array of smaller devices separated by inductors. These inductors are often realized by narrow width (high impedance) transmission lines. The transmission lines and transistors are arranged in a ladder configuration that forms a synthetic transmission line. The result is a system that advantageously absorbs the transistor capacitance into a broadband transmission line-like structure that can efficiently handle the necessary frequency range. Since a synthetic transmission line can operate from frequencies of 0 Hz up to some very high cutoff frequency, systems designed around the distributed amplifier approach can achieve virtually an infinite amount of octave bandwidth.

In passive applications such as switches and attenuators, the distributed approach shows up again as a preferred way to achieve broad bandwidths at high frequencies in the presence of significant transistor capacitance. The distributed topologies appear in such circuits where shunt transistors are needed, and they take the form of series high impedance line segments separated by shunt transistors.

FIG. 1 shows an exemplary prior art variable attenuator 100 incorporating a distributed transistor structure. Attenuator 100 includes a first series transistor 110, a distributed shunt transistor structure 120, a second series transistor 130, a first gate resistor 115, a second gate resistor 135, and shunt gate resistors 142, 144, 146 and 148. Distributed shunt transistor structure 120 includes a plurality of shunt transistors 122, 124, 126 and 128 separated by series inductors 121, 123, 125, 127 and 129. As explained above, shunt transistors 122, 124, 126 and 128 and series inductors 121, 123, 125, 127 and 129 form a synthetic transmission line, with the transistor capacitances being absorbed therein.

Attenuator 100 is a "T-type attenuator" structure. Series transistor 110, distributed shunt transistor structure 120, and second series transistor 130 each acts as a variable impedance according to the drive voltages supplied to the gates of the respective transistors. An RF, microwave, or millimeter wave signal to be attenuated is input to a first terminal (e.g., a drain) of first series transistor 110 and an attenuated signal is output from a second terminal (e.g., a source) of second series transistor 130. The operation of attenuator 100 is well-understood by those of skill in the art.

However, a principle weakness of the distributed approach relates to the synthetic transmission line itself. There is always a residual passband ripple, the amplitude of which is determined by the upper cutoff frequency and the number of sections in the synthetic transmission line. That is, the passband ripple can be improved, but doing so requires the addition of more sections to the synthetic transmission line. However, the number of sections is limited by the space available for laying out the circuit. Accordingly, a compromise is forced between bandwidth, ripple, and layout size, and the results are not always satisfactory.

What is needed, therefore, is an attenuator that can provide wideband, high attenuation without significant passband ripple. What is also needed is an attenuator with wideband, high frequency amplification capability that can be fabricated with a smaller size.

SUMMARY

In an example embodiment, an attenuator comprises: a first series transistor having first and second terminals and a gate, the first terminal adapted to receive an input signal to be attenuated, a first gate resistor connected between a first attenuator control voltage and the gate of the first series transistor; a second series transistor having first and second terminals and a gate, the second terminal adapted to output an attenuated output signal; a second gate resistor connected between a second attenuator control voltage and the gate of the second series transistor; a shunt transistor, comprising: a gate configured as a gate transmission line, a source configured as a source transmission line, and a drain configured as a drain transmission line; and a shunt gate resistor connected between a third attenuator control voltage and the gate of the shunt transistor. One of the source transmission line and the drain transmission line is connected to ground, and the other of the source transmission line and the drain transmission line extends between the second terminal of the first series transistor and the first terminal of the second series transistor and has a selected characteristic impedance.

In another example embodiment, a quadrature attenuator comprises: a first coupler having an input port adapted to receive an input signal to be attenuated, and two coupler ports; first and second transistors, each transistor comprising, a gate configured as a gate transmission line, a source configured as a source transmission line, and a drain configured as a drain transmission line, wherein one of the source transmission line and the drain transmission line is connected to ground, and wherein the other of the source transmission line and the drain transmission line has a first end and a second end and a selected characteristic impedance, the first end being connected to one of the two coupler ports of the first coupler; first and second gate resistors each connected between an attenuator control voltage and the gate of one of the first and second transistors; and an output port adapted to output an attenuated output signal.

In yet another embodiment, an attenuator having an input adapted to receive a signal to be attenuated, and an output adapted to output an attenuated signal, and a shunt transmission line transistor having a gate transmission line adapted to receive an attenuator control voltage, a source configured as a source transmission line, and a drain configured as a drain transmission line, wherein one of the source transmission line and drain transmission line is connected to ground and wherein the signal to be attenuated passes through the other of the source transmission line and drain transmission line.

BRIEF DESCRIPTION OF THE DRAWINGS

The example embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DETAILED DESCRIPTION

In the following detailed description, for purposes of explanation and not limitation, example embodiments disclosing specific details are set forth in order to provide a thorough understanding of an embodiment according to the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparati and methods may be omitted so as to not obscure the description of the example embodiments. Such methods and apparati are clearly within the scope of the present teachings.

In the description to follow, when it is said that two or more components or points are connected to each other, it should be understood that does not preclude the possibility of the existence of intervening elements or components. In contrast, when it is said that two or more components or points are directly connected to each other, it should be understood that the two components or points are connected without any intervening components or circuits that significantly affect a signal passed across the connection. However a conductive contact, wire, or line which does not present substantial capacitance, inductance, or resistance at frequencies of interest may be used to directly connect the two or more components or points. Also, as used herein, a "line" means something that is distinct, elongated, and relatively narrow. It can be curved, straight, or bent unless otherwise indicated. It is not to be construed in a strict mathematical sense as having no width, or as being generated by a moving point, unless otherwise specifically indicated.

Figure 1:
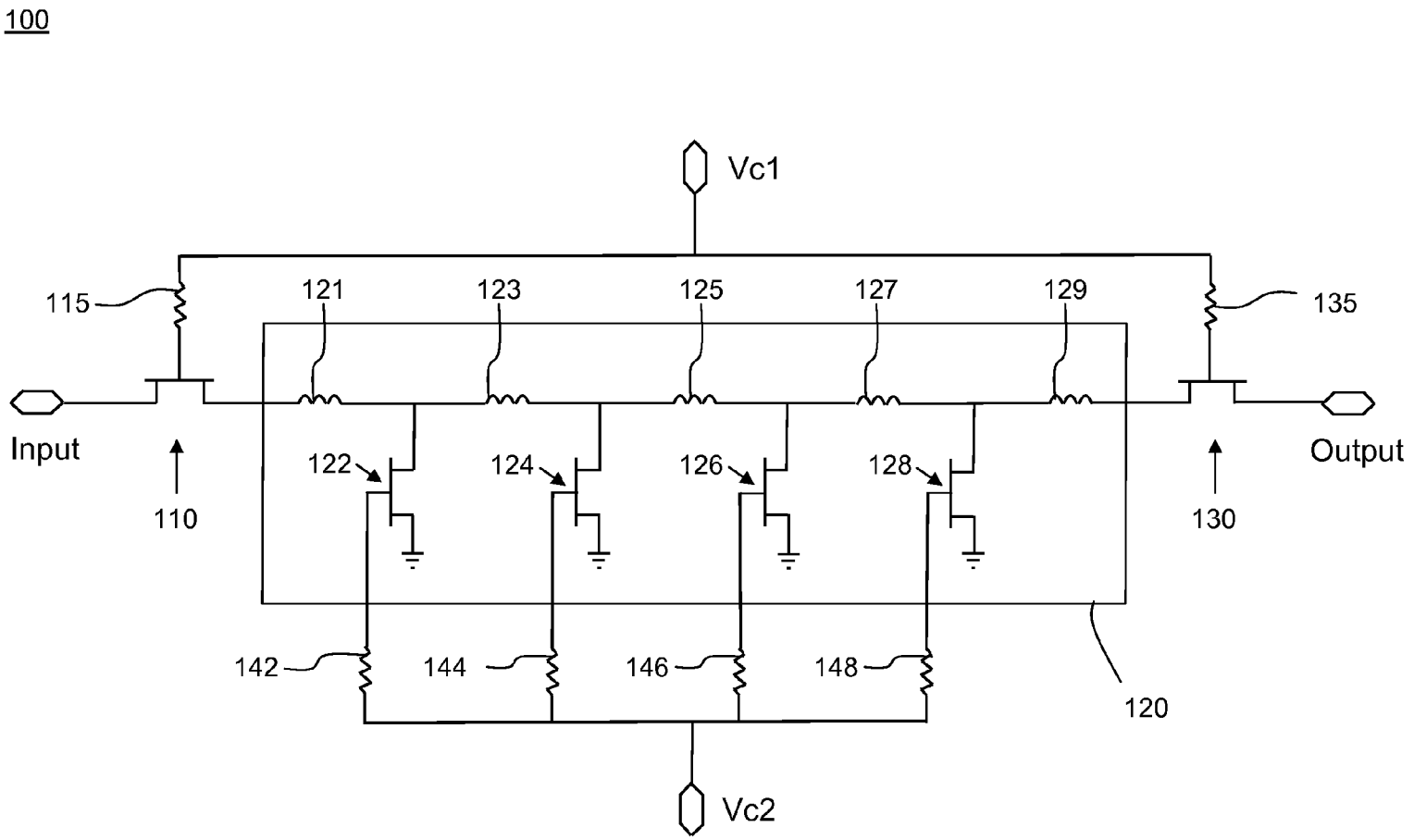
FIG. 1 (PRIOR ART)
FIG. 1 shows a schematic diagram of a prior art variable attenuator.
Figure 2:
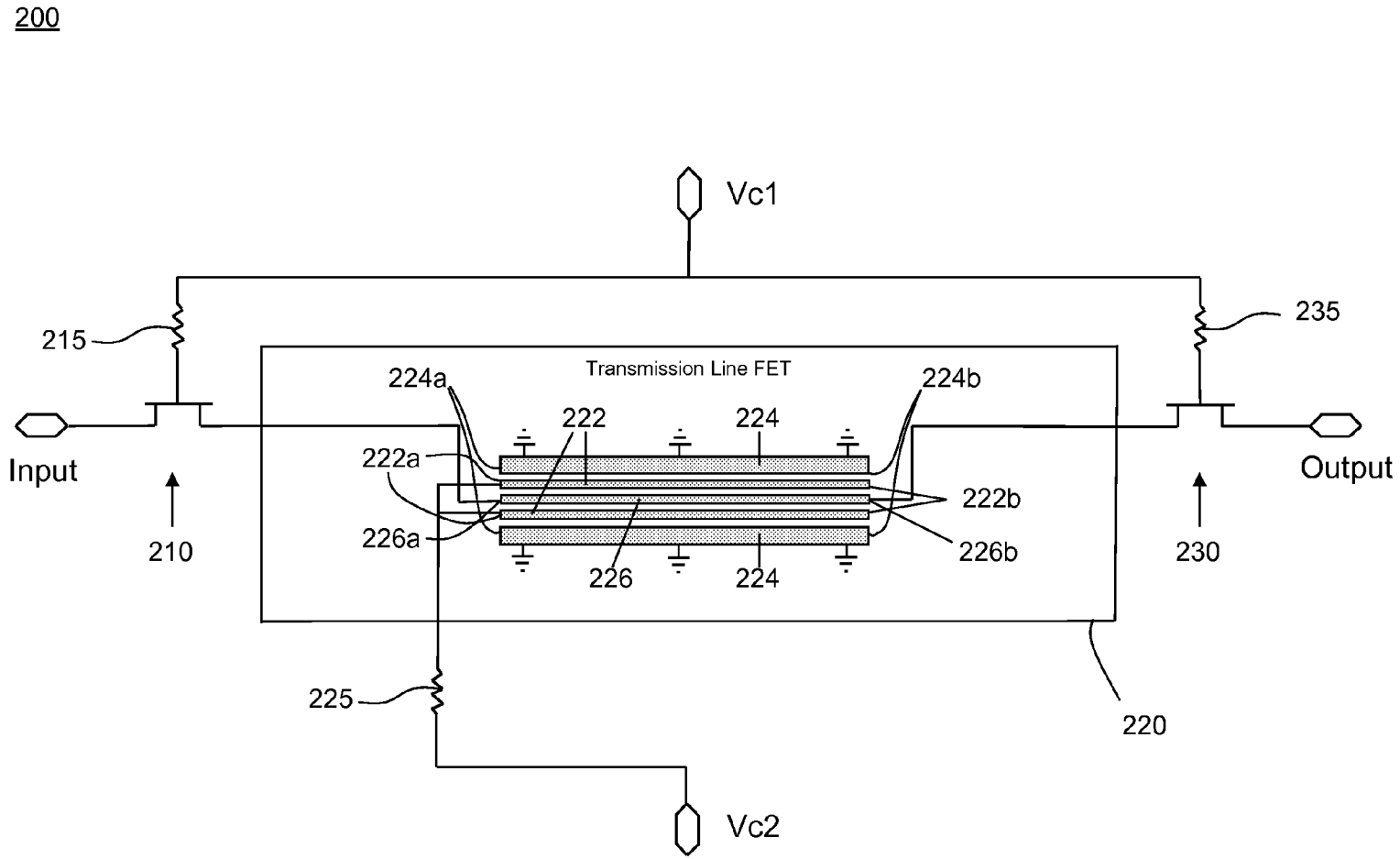
FIG. 2 shows a schematic diagram of one embodiment of a variable attenuator including a shunt transmission line transistor.

FIG. 2 shows a schematic diagram of one embodiment of a variable attenuator 200 including a shunt transmission line transistor. Attenuator 200 includes first series transistor 210, a shunt transmission line transistor 220, a second series transistor 230, a first gate resistor 215, a second gate resistor 225, and a shunt gate resistor 235.

Shunt transmission line transistor 220 is a two-finger FET, having a split gate 222, a split source 224, and a drain 226. In shunt transmission line transistor 220, gate 222, source 224, and drain 226 are each configured to operate as transmission lines at operating frequencies of attenuator 200. The finger traces of gate 222 are configured as a gate transmission line, the finger traces of source 224 are configured as a source transmission line, and the finger trace of drain 226 is configured as a drain transmission line having a selected characteristic impedance, as discussed in more detail below. Gate 222 has an input at a first end 222*a* of its finger traces, and an output at a second end 222*b* of its finger traces. Source 224 has an input at a first end 224*a* of its finger traces, and an output at a second end 224*b* of its finger traces. Drain 226 has an input at a first end 226*a* of its finger trace, and an output at a second end 226*b* of its finger trace.

In the embodiment of FIG. 2, first series transistor 210 has first and second terminals and a gate. The first terminal (e.g., the drain) is adapted to receive an input signal (i.e., an RF, microwave, or millimeter wave signal) to be attenuated. First gate resistor 215 is connected between a first attenuator control voltage and the gate of first series transistor 210. Second series transistor 230 has first and second terminals and a gate. The second terminal (e.g., the source) is adapted to output an attenuated output signal. Second gate resistor 235 is connected between a second attenuator control voltage and the gate of second series transistor 230. In one embodiment, the first and second attenuator control voltages may be the same voltage. The source transmission line of shunt transmission line transistor 220 is connected to ground, while the drain transmission line of shunt transmission line transistor 220 extends between the second terminal (e.g., the source) of first series transistor 210 and the first terminal (e.g., the drain) of second series transistor 230. Shunt gate resistor 235 is connected between a third attenuator control voltage and the gate of shunt transmission line transistor 220.

Attenuator 200 is a "T-type attenuator" structure. Each of first series transistor 210, shunt transmission line transistor 220, and second series transistor 230 acts as a variable impedance according to the drive voltages supplied to the gates of the respective transistors. An RF, microwave, or millimeter wave signal to be attenuated is input to a first terminal (e.g., a drain) of first series transistor 220, passes through the drain transmission line of shunt transmission line transistor 220, and an attenuated signal is output from a second terminal (e.g., a source) of second series transistor 230. The operation of attenuator 200 would be well-understood by those of skill in the art from inspection of FIG. 2.

According to this arrangement as illustrated in FIG. 2, the capacitance of shunt transmission line transistor 220 is distributed in a continuous fashion along the gate, source, and drain transmission lines. As a result, the bandwidth of shunt transmission line transistor 220 can be made quite large, and the ripple can be made almost nonexistent when proper impedances of the transmission lines are selected.

In order for transistor 220 to operate as a transmission line transistor, the geometric widths of the finger trace of the drain must be selected with care to produce the desired characteristic impedance, $Z_O$, according to Equation (1):

$$Z_O=(L/C)^{1/2} \tag{1}$$

where L and C are the inductance and capacitance, respectively, per unit length of transmission line. To achieve the desired characteristic impedance for the transmission line of drain 226, the width of the finger trace(s) must be selected with care. A variety of methods are available to accomplish this, including electromagnetic (E/M) field solvers, analytical methods, and empirical methods. For example, in one particular p-High Electron Mobility Transistor (p-HEMT) technology, a characteristic impedance of 50 ohms was achieved with a finger trace having a width of 10 μm.

It should be understood that a specific characteristic impedance is only achievable under a specific bias condition for the transistor. In the attenuator 200, the bias condition of greatest interest is the pinch-off voltage, when attenuator 200 is operating at minimum attenuation. Under all other conditions, first and second series transistors 210 and 230 may be operated to provide the desired impedance match at the input and output ports of attenuator 200.

In many applications, the transmission line transistor will be operated in a circuit with a system impedance of 50 ohms. In that case, it will be desired that the selected characteristic impedance of the drain line is also 50 ohms.

It should be noted that a transmission line is in general a four port arrangement. Often, however, the transmission line is provided opposite a ground plane, so that the characteristic impedance of the transmission line is with respect to ground. It also should be noted that the characteristic impedance of drain line 226 is affected by the connections of the remaining transistor terminals to surrounding circuitry (e.g., to the remaining circuitry of the attenuator). In particular, the characteristic impedance of the drain transmission line is affected by the connection of source 224 to ground. Therefore, it should be understood that when we refer to the characteristic impedance of the drain transmission line, we are referring to the characteristic of the drain transmission line with respect to ground, when the source is connected to ground.

Of course it is also possible to fabricate the transmission line transistor with only one finger trace, or with more than two finger traces. When multiple finger traces are included in the transmission line transistor it becomes necessary to adjust the width of each finger trace so that the aggregate of all of the finger traces produces the desired characteristic impedance. However, in general there is a practical limit to the number of finger traces that can be employed while maintaining a desired characteristic impedance, due to the constraints on the minimum width for a finger trace set by limitations of the fabrication technology. The maximum number of finger traces that can be employed is set by the fabrication technology itself. For example, with less capacitance per unit length, one could select more finger traces for the same resultant characteristic impedance.

Furthermore, although in attenuator 200 the source transmission line of the transmission line transistor is grounded and the signal to be attenuated passes along the drain transmission line from the second terminal (e.g., source) of first series transistor 210 to the first terminal (e.g., a drain) of second series transistor 230, in an alternative embodiment the drain transmission line may be grounded and the signal to be attenuated may pass along the source transmission line from the second terminal (e.g., source) of first series transistor 210 to the first terminal (e.g., a drain) of second series transistor 230.

FIG. 2 illustrates one example of an attenuator topology employing a transmission line transistor as a shunt device. A variety of other attenuator topologies are possible employing a transmission line transistor as a shunt device. Two additional exemplary topologies will be described below with respect to FIGS. 3 and 4.

Figure 3:
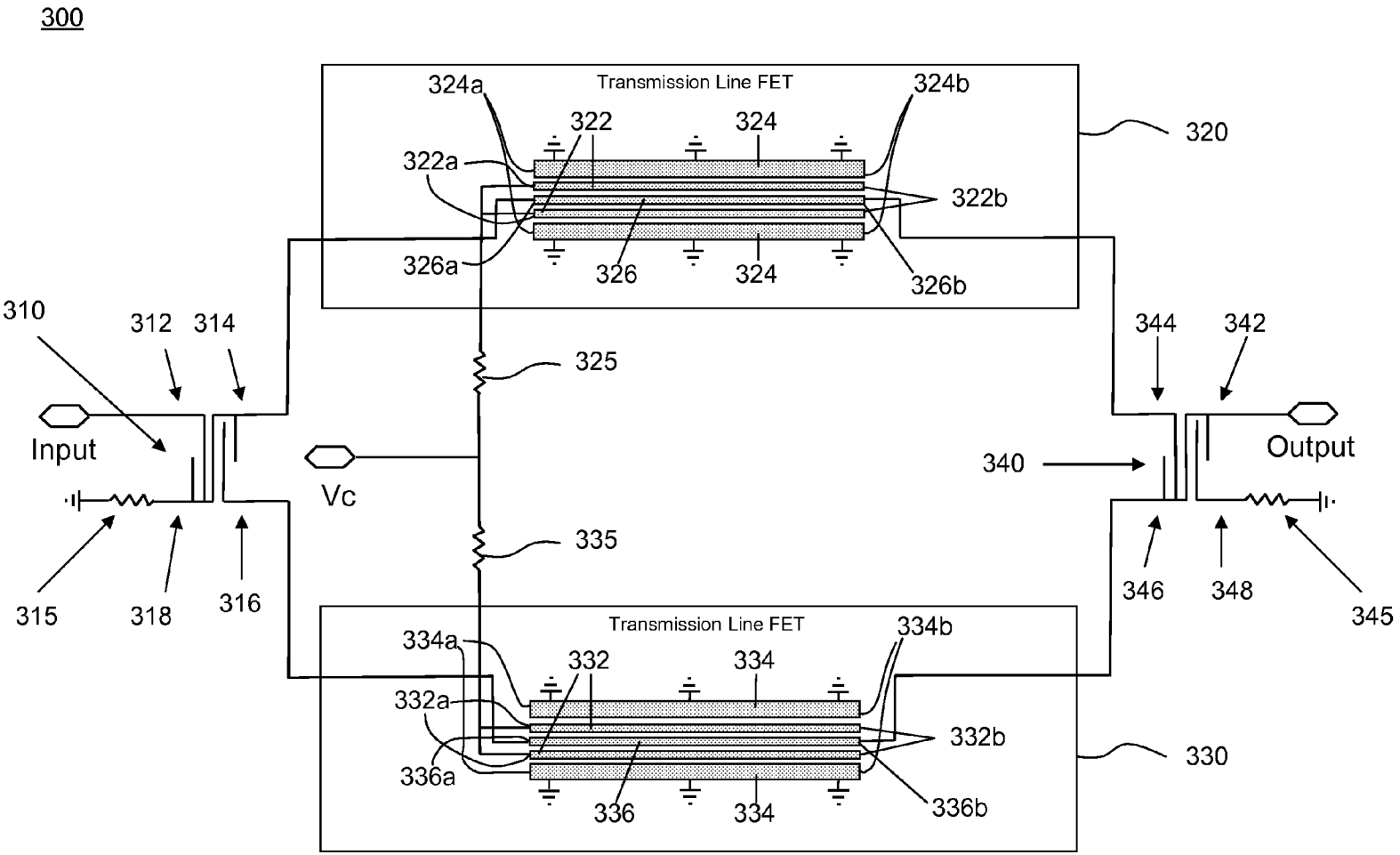
FIG. 3 shows a schematic diagram of one embodiment of a quadrature transmissive attenuator including shunt transmission line transistors.

FIG. 3 shows a schematic diagram of one embodiment of a quadrature transmissive attenuator 300 including shunt transmission line transistors. Attenuator 300 includes a first coupler 310, a first transmission line transistor 320, a second transmission line transistor 330, a second coupler 340, a first load impedance 315, a second load impedance 345, and first and second gate resistors 325 and 335.

First coupler 310 has an input port 312 adapted to receive an input signal to be attenuated, two coupler ports 314/316, and a load port 318. First load impedance 315 is connected between load port 318 and ground. Second coupler 340 has an output port 342 adapted to output an attenuated output signal, two coupler ports 344/346, and a load port 348. Second load impedance 345 is connected between load port 342 and ground.

First transmission line transistor 320 is a two-finger FET, having a split gate 322, a split source 324, and a drain 326. In transmission line transistor 320, gate 322, source 324, and drain 326 are each configured to operate as transmission lines at operating frequencies of attenuator 300. The finger traces of gate 322 are configured as a gate transmission line, the finger traces of source 324 are configured as a source transmission line, and the finger trace of drain 326 is configured as a drain transmission line having a selected characteristic impedance. Gate 322 has an input at a first end 322*a* of its finger traces, and an output at a second end 322*b* of its finger traces. Source 324 has an input at a first end 324*a* of its finger traces, and an output at a second end 324*b* of its finger traces. Drain 326 has an input at a first end 326*a* of its finger trace, and an output at a second end 326*b* of its finger trace.

Second transmission line transistor 330 is also a two-finger FET, having a split gate 332, a split source 334, and a drain 336. In transmission line transistor 330, gate 332, source 334, and drain 336 are each configured to operate as transmission lines at operating frequencies of attenuator 300. The finger traces of gate 332 are configured as a gate transmission line, the finger traces of source 334 are configured as a source transmission line, and the finger trace of drain 336 is configured as a drain transmission line having a selected characteristic impedance. Gate 332 has an input at a first end 332*a* of its finger traces, and an output at a second end 332*b* of its finger traces. Source 334 has an input at a first end 334*a* of its finger traces, and an output at a second end 334*b* of its finger traces. Drain 336 has an input at a first end 336*a* of its finger trace, and an output at a second end 336*b* of its finger trace.

In the embodiment of FIG. 3, input port 312 of first coupler 310 is adapted to receive an input signal (i.e., an RF, microwave, or millimeter wave signal) to be attenuated and output port 342 of second coupler 340 is adapted to output an attenuated output signal. The source transmission line of each of the first and second transmission line transistors 320/330 is connected to ground, while the drain transmission line of each of the first and second transmission line transistors 320/330 extends between a corresponding one of the coupler ports 314/316 of first coupler 310, and a corresponding one of the coupler ports 344/346 of second coupler 340. First and second shunt transistor gate resistors 325/335 are each connected between an attenuator control voltage and the gate of a corresponding one of first and second transmission line transistors 320/330.

Each of first and second transmission line transistors 320/330 acts as a variable impedance according to the drive voltage supplied to the gate of the respective transistor. An RF, microwave, or millimeter wave signal to be attenuated passes through the drain transmission lines of transmission line transistors 320/330. The operation of attenuator 300 would be well-understood by those of skill in the art from inspection of FIG. 3.

According to this arrangement as illustrated in FIG. 3, the capacitance of each of the transmission line transistors 320/330 is distributed in a continuous fashion distributed along the gate, source, and drain transmission lines. As a result, the bandwidth of shunt transmission line transistors 320/330 can be made quite large, and the ripple can be made almost nonexistent when the impedances of the transmission lines are selected with care.

Attenuator 300 employs only shunt devices. Input and output port matching is achieved by couplers 310 and 340, so series transistors are not required.

As before, the bias condition of greatest interest for first and second transmission line transistors 320/330 is the pinch-off voltage, when attenuator 300 is operating at minimum attenuation.

As with the embodiment of FIG. 2, it is also possible to fabricate the transmission line transistors with only one finger trace, or with more than two finger traces. Furthermore, although in attenuator 300 the source transmission line of the transmission line transistors 320/330 is grounded and the signal to be attenuated passes along the drain transmission line between first coupler 310 and second coupler 340, in an alternative embodiment the drain transmission lines may be grounded and the signal to be attenuated may pass along the source transmission lines between first coupler 310 and second coupler 340.

Figure 4:
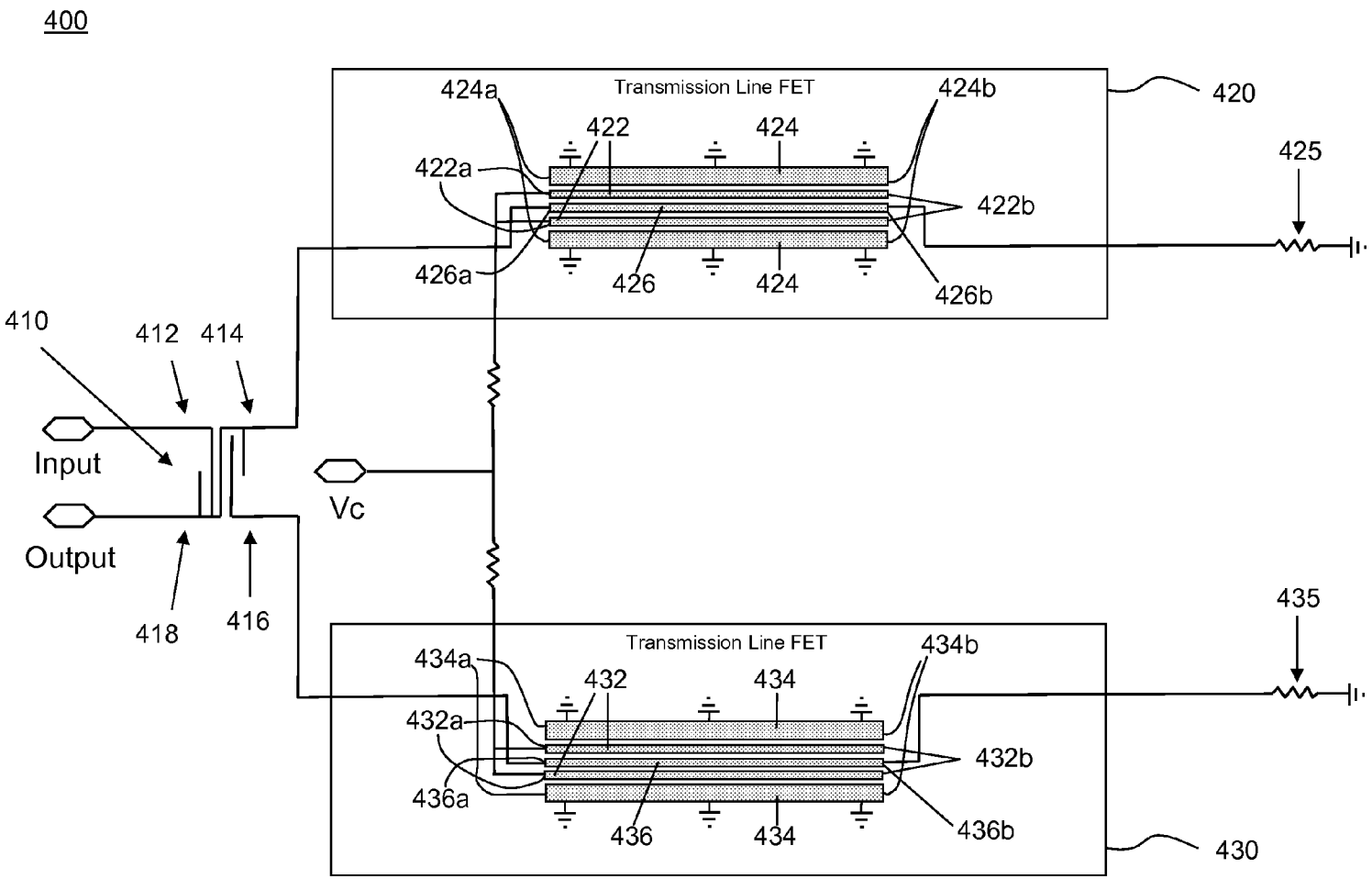
FIG. 4 shows a schematic diagram of one embodiment of a quadrature reflective attenuator including shunt transmission line transistors.

FIG. 4 shows a schematic diagram of one embodiment of a quadrature reflective attenuator 400 including shunt transmission line transistors. Attenuator 400 includes a first coupler 410, a first transmission line transistor 420, a second transmission line transistor 430, a first load impedance 415, a second load impedance 445, and first and second gate resistors 425 and 435.

First coupler 410 has an input port 412 adapted to receive an input signal to be attenuated, two coupler ports 414/416, and an output port 418 adapted to output an attenuated output signal.

First transmission line transistor 420 is a two-finger FET, having a split gate 422, a split source 424, and a drain 426. In transmission line transistor 420, gate 422, source 424, and drain 426 are each configured to operate as transmission lines at operating frequencies of attenuator 400. The finger traces of gate 422 are configured as a gate transmission line, the finger traces of source 424 are configured as a source transmission line, and the finger trace of drain 426 is configured as a drain transmission line having a selected characteristic impedance. Gate 422 has an input at a first end 422*a* of its finger traces, and an output at a second end 422*b* of its finger traces. Source 424 has an input at a first end 424*a* of its finger traces, and an output at a second end 424*b* of its finger traces. Drain 426 has an input at a first end 426*a* of its finger trace, and an output at a second end 426*b* of its finger trace.

Second transmission line transistor 430 is also a two-finger FET, having a split gate 432, a split source 434, and a drain 436. In transmission line transistor 430, gate 432, source 434, and drain 436 are each configured to operate as transmission lines at operating frequencies of attenuator 400. The finger traces of gate 432 are configured as a gate transmission line, the finger traces of source 434 are configured as a source transmission line, and the finger trace of drain 436 is configured as a drain transmission line having a selected characteristic impedance. Gate 432 has an input at a first end 432*a* of its finger traces, and an output at a second end 432*b* of its finger traces. Source 434 has an input at a first end 434*a* of its finger traces, and an output at a second end 434*b* of its finger traces. Drain 436 has an input at a first end 436*a* of its finger trace, and an output at a second end 436*b* of its finger trace.

In the embodiment of FIG. 4, input port 412 of first coupler 410 is adapted to receive an input signal (i.e., an RF, microwave, or millimeter wave signal) to be attenuated and output port 418 of second coupler 440 is adapted to output an attenuated output signal. The source transmission line of each of the first and second transmission line transistors 420/430 is connected to ground, while the drain transmission line of each of the first and second transmission line transistors 420/430 extends between a corresponding one of the coupler ports 414/416 of first coupler 410, and a corresponding one of first and second load impedances 415/445. First and second gate resistors 425/435 are each connected between an attenuator control voltage and the gate of a corresponding one of first and second transmission line transistors 420/430.

First load impedance 425 is connected between second end 426*b* of drain 426 of first transmission line transistor 420 and ground. Second load impedance 435 is connected between second end 436*b* of drain 436 of first transmission line transistor 430 and ground.

Each of first and second transmission line transistors 420/430 acts as a variable impedance according to the drive voltage supplied to the gate of the respective transistor. An RF, microwave, or millimeter wave signal to be attenuated passes through the drain transmission lines of transmission line transistors 420/430. The operation of attenuator 400 would be well-understood by those of skill in the art from inspection of FIG. 4.

According to this arrangement as illustrated in FIG. 4, the capacitance of each of the transmission line transistors 420/430 is distributed in a continuous fashion along the gate, source, and drain transmission lines. As a result, the bandwidth of transmission line transistors 420/430 can be made quite large, and the ripple can be made almost nonexistent when the impedances of the transmission lines are selected with care.

Attenuator 400 employs only shunt devices. Input and output port matching is achieved by coupler 410, so series transistors are not required.

As before, the bias condition of greatest interest for first and second shunt transmission line transistors 420/430 is the pinch-off voltage, in this case when attenuator 400 is operating at minimum attenuation.

As with the embodiments of FIGS. 2 and 3, it is also possible to fabricate the transmission line transistors with only one finger trace, or with more than two finger traces. Furthermore, although in attenuator 400 the source of each transmission line transistor is grounded and the signal to be attenuated passes along the drain transmission line, in an alternative embodiment the drain transmission lines may be grounded and the signal to be attenuated may pass along the source transmission lines.

While example embodiments are disclosed herein, one of ordinary skill in the art appreciates that many variations that are in accordance with the present teachings are possible and remain within the scope of the appended claims. The embodiments therefore are not to be restricted except within the scope of the appended claims.

The invention claimed is:

1. An attenuator, comprising:

a first series transistor having first and second terminals and a gate, the first terminal adapted to receive an input signal to be attenuated;

a first gate resistor connected between a first attenuator control voltage and the gate of the first series transistor;

a second series transistor having first and second terminals and a gate, the second terminal adapted to output an attenuated output signal;

a second gate resistor connected between a second attenuator control voltage and the gate of the second series transistor;

a shunt transistor, comprising:

a gate configured as a gate transmission line, a source configured as a source transmission line, and a drain configured as a drain transmission line, wherein one of the source transmission line and the drain transmission line is connected to ground, and wherein the other of the source transmission line and the drain transmission line extends between the second terminal of the first series transistor and the first terminal of the second series transistor and has a selected characteristic impedance; and a shunt gate resistor connected between a third attenuator control voltage and the gate of the shunt transistor.

2. The attenuator of claim 1, wherein the selected characteristic impedance is 50 ohms.

3. The attenuator of claim 1, wherein the gate comprises two gate finger traces separated and spaced apart from each other, the two gate finger traces being connected to each other at a first end of the gate.

4. The attenuator of claim 3, wherein the drain is disposed between the two gate fingers.

5. The attenuator of claim 4, wherein the source comprises two source finger traces separated and spaced apart from each other.

6. The attenuator of claim 1, wherein the first attenuator control voltage is the same as the second attenuator control voltage.

7. A quadrature attenuator, comprising:

a first coupler having an input port adapted to receive an input signal to be attenuated, and two coupler ports;

first and second transistors, each transistor comprising, a gate configured as a gate transmission line, a source configured as a source transmission line, and a drain configured as a drain transmission line, wherein one of the source transmission line and the drain transmission line is connected to ground, and wherein the other of the source transmission line and the drain transmission line has a first end and a second end and a selected characteristic impedance, the first end being connected to one of the two coupler ports of the first coupler;

first and second gate resistors each connected between an attenuator control voltage and the gate of one of the first and second transistors; and an output port adapted to output an attenuated output signal.

8. The attenuator of claim 7, wherein the attenuator is a quadrature transmissive attenuator, and wherein the first coupler further comprises a load port, the attenuator further comprising:

a second coupler having, the output port adapted to output the attenuated output signal, a load port, and two coupler ports each coupled to the second end of the other of the source transmission line and the drain transmission line of each of the first and second transistors, having the first end connected to one of the two coupler ports of the first coupler;

a first load impedance connected between the load port of the first coupler and ground; and a second load impedance connected between the load port of the second coupler and ground.

9. The attenuator of claim 8, wherein the first and second load impedances are each 50 ohms.

10. The attenuator of claim 8, wherein the gate of each of the first and second transistors comprises two gate finger traces separated and spaced apart from each other, the two gate finger traces being connected to each other at a first end of the gate.

11. The attenuator of claim 10, wherein the drain of each transistor is disposed between the two gate fingers.

12. The attenuator of claim 11, wherein the source of each transistor comprises two source finger traces separated and spaced apart from each other.

13. The attenuator of claim 7, wherein the attenuator is a quadrature reflective attenuator, and wherein the first coupler further comprises the output port, the attenuator further comprising:

a first load impedance connected between ground and the second end of the other one of the source transmission line and drain transmission line of the first transistor, having the first end connected to one of the two coupler ports of the first coupler; and a second load impedance connected between ground and the second end of the other one of the source transmission line and drain transmission line of the second transistor, having the first end connected to one of the two coupler ports of the first coupler.

14. The attenuator of claim 13, wherein the first and second load impedances are each 50 ohms.

15. The attenuator of claim 13, wherein the gate of each of the first and second transistors comprises two gate finger traces separated and spaced apart from each other, the two gate finger traces being connected to each other at a first end of the gate.

16. The attenuator of claim 15, wherein the drain of each transistor is disposed between the two gate fingers.

17. The attenuator of claim 16, wherein the source of each transistor comprises two source finger traces separated and spaced apart from each other.

18. An attenuator having an input adapted to receive a signal to be attenuated, and an output adapted to output an attenuated signal, and a shunt transmission line transistor having a gate transmission line adapted to receive an attenuator control voltage, a source configured as a source transmission line, and a drain configured as a drain transmission line, wherein one of the source transmission line and drain transmission line is connected to ground and wherein the signal to be attenuated passes through the other of the source transmission line and drain transmission line.

19. The attenuator of claim 18, further including first and second series transistors connected at opposite ends of the other of the source transmission line and drain transmission line.

20. The attenuator of claim 18, wherein the attenuator is one of a quadrature reflective attenuator and a quadrature transmissive attenuator.

* * * * *